US009345318B2

(12) United States Patent
Kollreider et al.

(10) Patent No.: US 9,345,318 B2
(45) Date of Patent: May 24, 2016

(54) TABLE WITH A HEIGHT-ADJUSTABLE TABLETOP

(71) Applicant: Daniel Kollreider, Graz (AT)

(72) Inventors: Daniel Kollreider, Graz (AT); Stefan Lukas, Preding (AT); Walter Koch, Schwanberg (AT)

(73) Assignee: LOGICDATA ELECTRONIC & SOFTWARE ENTWICKLUNGS GMBH, Deutschlandsberg (AT)

( * ) Notice: Subject to any disclaimer, the term of this patent is extended or adjusted under 35 U.S.C. 154(b) by 0 days.

(21) Appl. No.: 14/383,090

(22) PCT Filed: Feb. 21, 2013

(86) PCT No.: PCT/EP2013/053453
§ 371 (c)(1),
(2) Date: Sep. 4, 2014

(87) PCT Pub. No.: WO2013/131755
PCT Pub. Date: Sep. 12, 2013

(65) Prior Publication Data

US 2015/0007756 A1 Jan. 8, 2015

(30) Foreign Application Priority Data

Mar. 6, 2012 (DE) ..... 10 2012 101 890

(51) Int. Cl.
*A47B 9/00* (2006.01)
*A47B 9/20* (2006.01)
(Continued)

(52) U.S. Cl.
CPC ... *A47B 9/20* (2013.01); *A47B 9/04* (2013.01); *A47B 13/00* (2013.01); *A47B 2200/0052* (2013.01); *A47B 2200/0059* (2013.01)

(58) Field of Classification Search
CPC ..... A47B 9/00; A47B 9/04; A47B 9/02; A47B 9/10; A47B 9/20; A47B 13/00; A47B 2200/0052; A47B 2200/0059; H01H 3/26
USPC ..... 108/147, 147.11, 147.19, 20; 318/7, 3; 248/188.2, 188.1, 188.5, 162.1, 404, 248/188.4
See application file for complete search history.

(56) References Cited

U.S. PATENT DOCUMENTS 4,667,605 A * 5/1987 Bastian ..... 108/147
5,224,429 A 7/1993 Borgman et al.
5,259,326 A 11/1993 Borgman et al.
(Continued)

FOREIGN PATENT DOCUMENTS

DE 4023768 A1 1/1992
DE 4417337 A1 11/1995
(Continued)

*Primary Examiner* — Jose V Chen
(74) *Attorney, Agent, or Firm* — McDermott Will & Emery LLP

(57) ABSTRACT

A table (TBL) with a height-adjustable tabletop (PL) comprises an electrical drive (EA) for adjusting the height of the tabletop (PL) and a braking mechanism (BR) for selective prevention of a downward movement of the tabletop (PL). A self-locking of the drive (EA) is designed in such a manner that the tabletop (PL) moves downward in the event of a defined load on the tabletop (PL). The table further comprises an energy accumulator (BAT, FE), wherein the table (TBL) is designed in such a manner that energy resulting from a downward movement of the tabletop (PL) is stored at least in part in the energy accumulator (BAT, FE).

19 Claims, 5 Drawing Sheets

(51) Int. Cl.

| | |
|---|---|
| ***A47B 9/04*** | (2006.01) |
| ***A47B 13/00*** | (2006.01) |

(56) References Cited

U.S. PATENT DOCUMENTS

| | | | | |
|---|---|---|---|---|
| 5,461,974 | A * | 10/1995 | Reneau | 108/147 |
| 5,657,498 | A * | 8/1997 | Hum | 108/147 |
| 6,286,441 | B1 * | 9/2001 | Burdi et al. | 108/147 |
| 6,352,037 | B1 * | 3/2002 | Doyle | 108/20 |
| 7,063,024 | B2 * | 6/2006 | Latino | 108/50.01 |
| 7,658,359 | B2 * | 2/2010 | Jones et al. | 248/406.1 |
| 8,040,082 | B2 * | 10/2011 | Bastholm | 318/135 |
| 8,084,966 | B2 * | 12/2011 | Dewert | 318/7 |
| 8,210,109 | B1 * | 7/2012 | Dewees | 108/147 |
| 8,240,257 | B2 * | 8/2012 | Frost | 108/20 |
| 9,038,549 | B1 * | 5/2015 | Zebarjad | 108/147 |
| 2001/0037751 | A1 * | 11/2001 | Agee | 108/147 |
| 2012/0068635 | A1 | 3/2012 | Koch et al. | |

FOREIGN PATENT DOCUMENTS

| | | | |
|---|---|---|---|
| DE | 20113582 | U1 | 12/2001 |
| DE | 10216774 | A1 | 10/2003 |
| DE | 102009015690 | A1 | 10/2010 |
| DE | 202010007713 | U1 | 10/2010 |
| EP | 1488538 | A1 | 12/2004 |

* cited by examiner

TABLE WITH A HEIGHT-ADJUSTABLE TABLETOP

The invention relates to a table with a height-adjustable tabletop, in particular with an electrical drive for adjusting the height of the tabletop.

Electrically adjustable furniture is being offered for sale more and more often. Thus the height of the table top for many types of tables, especially desks, can be adjusted electrically via a special drive.

In conventional height-adjustable tables, the drive has a self-locking design, by means of special gear units or threaded spindles for example. For such self-locking, for example, it is ensured by means of friction in the gear unit or the spindle system that the tabletop does not slip down with a defined load on the table. With such a design, the drive requires electrical energy from a controller for downward travel in order to overcome the frictional force of the self-locking and move the system, even when the tabletop is fully loaded.

One object to be achieved is to specify a more energy-efficient concept for an electrically height-adjustable table.

This problem is achieved with the subject matter of the independent claim. Refinements and configurations are subject matter of the dependent claims.

For example, one energy-efficient solution is based on the idea of forgoing self-locking of the electrical drive and deliberately providing a braking mechanism that prevents downward motion of the tabletop even under a maximum possible load on the table or the table top. If the braking mechanism is not activated, then the tabletop slips downward on its own depending on the load on the tabletop. At the same time, however, less energy is required for the drive during a downward movement, especially because a lower force needs to be exerted due to the lack of self-locking. Furthermore, an energy accumulator is provided, which receives, at least in part, an energy resulting from the downward movement of the table top, which energy may be output again during upward movement of the tabletop. Thereby less energy is required by the electrical drive during the upward movement of the tabletop. The energy efficiency of the table is therefore improved.

In one embodiment example, a table with a height-adjustable tabletop comprises an electrical drive for height adjustment of the tabletop, wherein a self-locking of the drive is designed in such a manner that a downward movement of the tabletop without the supply of additional energy takes place in case of a defined load on the tabletop. The table further comprises an energy accumulator and a braking mechanism for selective prevention of a downward movement of the tabletop. The table is designed in such a manner that energy resulting from a downward movement of the tabletop is stored at least in part in the energy accumulator.

In one configuration, the energy stored in the energy accumulator can be used for an upward movement of the tabletop.

The defined load, which results in a downward movement of the tabletop without the supply of additional energy, may be set by a mechanical construction of the table and/or the drive and is preferably chosen well below a load that would lead to a destruction of the mechanical components of the table. For example, the defined load is based on a weight of the table top with or without any standard devices placed on top of the tabletop like a telephone set, a display, a keyboard etc.

In order to initiate a downward movement of the tabletop, the braking mechanism is accordingly deactivated, so that the tabletop begins a downward movement due to the low degree of self-locking of the drive. The potential energy of the tabletop is transferred during the downward movement to the energy accumulator, at least in part. The energy accumulator can be a mechanical energy accumulator and/or an electrical energy accumulator. A mechanical spring, a flywheel or a mass element can be used as mechanical energy accumulators for storing potential energy, the energy being transmitted, for example, by a pulley arrangement to the mechanical energy accumulator. A capacitor or a rechargeable battery or storage battery, for example, can be used for an electrical energy accumulator.

The energy stored in the mechanical and/or electrical energy accumulator can be used in an upward movement of the table. If a rechargeable battery is used as the electrical energy accumulator, it can additionally be charged by an external energy source, so that other energy in addition to the stored potential energy is present in the energy accumulator and the electrical energy accumulator can be used for the entire energy supply of the electrical drive. Thus for example, the need for externally supplied electrical energy is reduced in comparison to a conventional electrically height-adjustable table.

In different embodiments, the table further comprises an H-bridge for controlling the drive. The energy accumulator comprises an electrical accumulator that is coupled to the H-bridge in order to output and absorb energy. For example, an H-bridge consists of an electronic bridge that is made of four semiconductor switches formed, for example, by transistors and can convert a DC voltage into an AC voltage with variable frequency and variable pulse width. Via the H-bridge, energy can be absorbed and can also be output with an appropriate position of the switch, so that the electrical drive can be used both in motor operation and generator operation. The energy produced in generator operation can be used to charge the electrical accumulator.

In some special configurations, the H-bridge is also designed to interact with the braking mechanism or to provide the braking mechanism on its own. In particular, the electrical drive can be held suspended by an appropriate control from the H-bridge, so that exactly as much force is exerted by the electrical drive as is necessary to prevent lowering of the tabletop. Thus a rest position of the tabletop can be achieved or adjusted, even with a deactivated braking mechanism, in particular deactivated mechanical components of the braking mechanism. This ultimately allows soft starting and stopping of the drive when moving the tabletop.

In different embodiments, the table further comprises a controller for the drive, wherein energy for the controller and the drive is supplied by the rechargeable battery that is comprised by the energy accumulator. For example, a charging mechanism comprising at least one solar cell is also provided for the battery. The battery is therefore charged in part by the energy from the downward movement of the tabletop and in part by the energy supplied by the solar cell.

Because electrically height-adjustable tables are usually adjusted only a few times per day, the rechargeable battery can be charged with a comparatively low current, because a longer charging time of the battery is not important to operation.

In alternative or additional configurations, a charging mechanism is provided for the battery. The table further comprises a computer interface coupled to the charging mechanism for supplying a charging current to the battery. Such a computer interface is formed, for example, by a Universal Serial Bus, USB, interface or an Ethernet interface constructed according to the Power over Ethernet standard, for example. Because height-adjustable tables are frequently used as computer workplaces, it is easy to take advantage of an already existing interface on the computer in order to charge the energy accumulator. Thereby it is possible to forgo provision of a special power adapter for the controller.

In different configurations, the controller is designed to exchange data via the computer interface with a computer connected via the interface. For example, control data can be transmitted to the controller by the computer in order to bring about a height-adjustment of the table. In addition, status data or position data can be transmitted from the controller to the connected computer. Thus it is possible to operate the table with a software program that is executed on the computer.

In different configurations, the controller is designed for operation without a power adapter. In particular, an energy supply for the drive comes completely from the energy stored in the electrical energy accumulator in this case.

In different configurations, the braking mechanism, which can be constructed mechanically or electromechanically, is designed for operation according to the frictional engagement principle or the positive engagement principle. In particular, the braking mechanism can be composed of different interacting elements. For example, the braking mechanism can comprise a friction brake on a motor shaft of the drive, a catch device, in particular with a gear, on a gear unit of the drive, a catch device on a threaded spindle of the drive or a self-regulating friction brake. With a catch device, for example, movement of the drive and thus height adjustment can be prevented selectively. In this case, an electromagnetically movable pin is engaged or disengaged with a gear, a toothed rack or a similar locking device. With a friction brake, a frictional force can be generated on the drive, which in turn prevents movement of the drive and height adjustment of the tabletop.

The self-locking of the drive is preferably designed such that, even with a non-loaded table in which only the weight of the tabletop acts in the downward direction, a downward movement of the tabletop is achieved when the braking mechanism is deactivated.

In different embodiments, the table is designed to deactivate the braking mechanism during a height adjustment of the tabletop and to activate the braking mechanism otherwise. In other words, the braking mechanism is preferably deactivated only during a height adjustment of the table top. The energy required for activation and deactivation of the braking mechanism is small in comparison to the energy required for overcoming the self-locking in a conventional table.

In different embodiments, the drive comprises at least one linear drive or linear actuator, particularly with a spindle drive. For example, such a spindle drive comprises a ball screw. A high spindle pitch can alternatively also be used to keep the self-locking of the drive low. This self-locking can also be reduced by providing a gear unit, in particular a planetary gear unit, with a low transmission ratio.

The rotary motion of an electrical motor, for example a DC motor, can be converted into the linear motion in the linear drive in various manners. For example, systems with gears, toothed racks, chains or cables can be used for this purpose. The DC motor is preferably provided for driving a spindle, which is suitable for converting a rotation of the motor into the linear motion of the linear drive.

In the previously described embodiments, a self-locking of the electrical drive is deliberately avoided. In this regard, a drive is understood not to be self-locking if the load acting from above onto the tabletop or the load force $F_L$ is greater than the opposing force $F_R$ produced by friction. The difference between these two forces can again be used during downward travel to recover energy in order to store the recovered energy in the energy accumulator. The smaller the opposing force $F_R$ is made, the more energy that can be recovered during downward travel. Accordingly, a braking force $F_B$ is added in the rest position for the described embodiment, so that the drive cannot slip down on its own. In particular, this braking force $F_B$ should be greater than the difference between the maximum load $F_{L,MAX}$ of the tabletop and the frictional force $F_R$. The frictional force $F_R$ is composed, for example, of the sum of all frictional moments, the static friction of a guide for the drive, a braking torque of the motor and other losses in the drive.

If a mechanical spring is used as a component of the energy accumulator for example, a spring force $F_S$ acting against the load $F_L$ is added to the frictional force $F_R$ and the braking force $F_B$. Thus it is possible that in case of a low load, for example, an empty tabletop, energy may be needed by the controller during downward travel. This required energy is used to overcome the spring force $F_S$, but is simultaneously also temporarily stored in the spring. Accordingly, the electrical drive requires less of the stored energy during upward travel, so that a motor power of the electrical drive can be reduced. Consequently, the motor of the electrical drives can be designed smaller than for conventional adjustable tables, which also can manifest itself in lower production costs.

A table according to the described embodiments can be operated by the energy accumulator, in particular an electrical energy accumulator, without a power system connection and a corresponding power adapter.

Due to the high efficiency and low friction of the system, a load change on the tabletop in the unbraked state of the system can be easily detected by the electric current or the returned energy. With this information, the controller for the drive can more easily detect a load change during an upward movement and/or a downward movement via the electric current or the returned energy, and can therefore realize an improved collision protection.

During a movement of the tabletop, the controller can accordingly be designed to carry out a collision recognition based on a current in the drive and/or an energy exchange with the energy accumulator, for example.

The information on the electric current and/or the returned energy can also be used for controlling the drive. For example, it is possible to bring the table into a floating condition by a switching element. In that case, the brake is released and the drive or drives is/are controlled in such a manner that the table holds its position. If a person presses on the tabletop or pulls on the tabletop, the controller can recognize this force exertion or force change on the basis of the current and can move the tabletop in the pushed or pulled direction by triggering the electrical drive for as long as the tabletop is pulled or pressed, for example.

Alternatively, the controller can recognize this force exertion or force change on the basis of a measurement signal from a pressure sensor in the drive or in the table leg that specifically records a pressure onto the tabletop. Such a sensor can be implemented with known technologies such as a piezo sensor, a load cell, elongation strips or the like. Such a sensor may already be provided for collision recognition, so that no additional construction expense results.

These embodiments have the additional advantage that the energy expended by people due to the exertion of force on the tabletop need not be provided by the controller, and the system can then get by with less supplied electrical energy.

For example, the controller can accordingly be designed to prevent a downward movement of the tabletop by controlling the drive when the braking mechanism is deactivated and to control a movement of the tabletop on the basis of a measurement of a force exerted onto the tabletop, more particularly on the basis of a current in the drive that results from the force exertion or on the basis of a signal from a pressure sensor in the drive for in the leg of the table.

The invention will be described in detail below for several embodiment examples with reference to figures. Identical reference numbers designate elements or components with identical functions. Insofar as circuit parts or components correspond to one another in function, a description of them will not be repeated in each of the following figures.

Therein:

Figure 1:
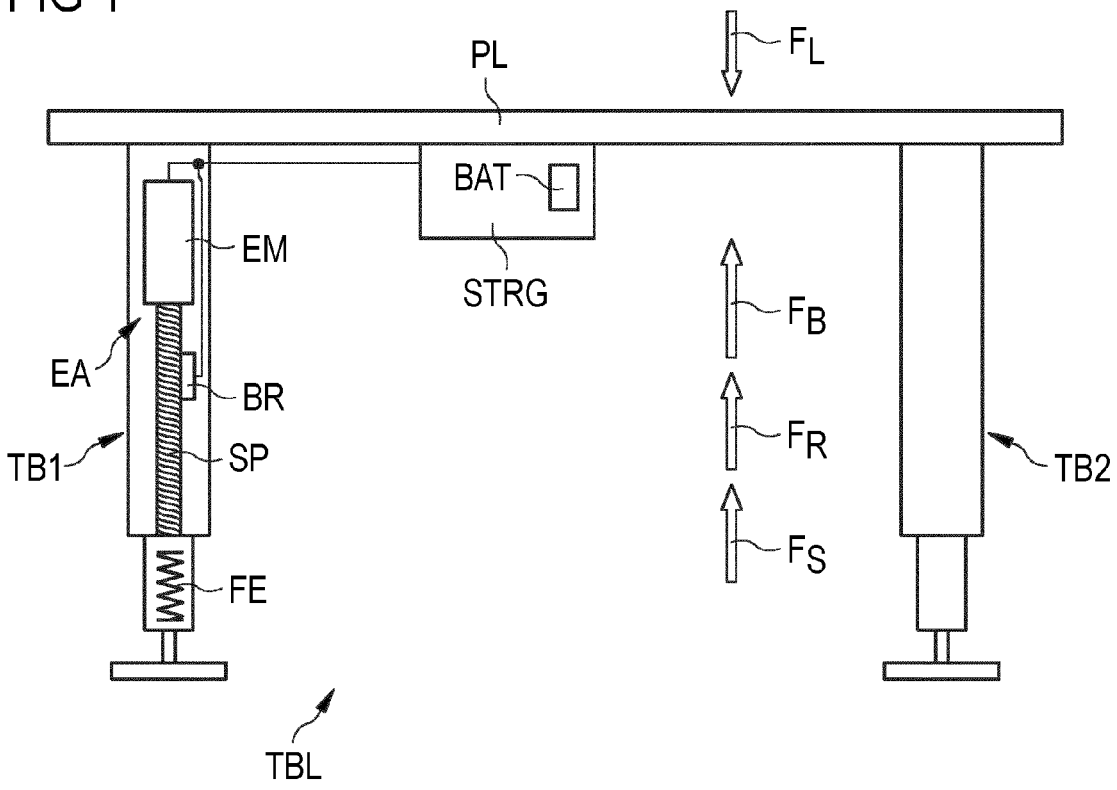
FIG. 1 shows an embodiment of a height-adjustable table.

FIG. 1 shows an embodiment of a table TBL with a height-adjustable tabletop PL. In addition to the tabletop PL, the table TBL has two table legs TB1, TB2 each comprising an electrical drive EA for performing the height adjustment. For reasons of clarity, the electrical drive EA is only shown in detail for the first table leg TB1.

The electrical drive EA comprises an electric motor EM, for example a DC motor, more particularly a brushless DC motor, or an AC motor such as a synchronous machine or an asynchronous machine. The electrical drive EA in this embodiment further comprises a threaded spindle SP, which can drive a carriage, not shown here, with a spindle nut that brings about the height adjustment. The electric motor EM is connected to a controller STRG, which supplies the electric motor EM with appropriate voltages for operation of the motor. The controller STRG comprises, for example, a rechargeable battery BAT, which serves as an energy source for operating the electrical drive EA.

In the table leg TB1, a braking mechanism BR is also provided, which can act in the illustrated embodiment on the spindle SP in order to prevent a movement of the spindle SP and thus a height adjustment of the table TBL.

A mechanical spring FE, which can absorb a force in the direction of the upward movement of the table leg TB1 or the tabletop PL, is also provided in the table leg TB1. Accordingly, the spring force of the spring FE in the illustrated embodiment also counteracts the load from above on the tabletop.

The electrical drive EA or the electric motor EM can be constructed in different embodiments both with a gear unit and without a gear unit. The electrical drive EA is dimensioned with respect to its components in such a manner that self-locking of the drive is avoided. This has the effect that, for a defined load on the tabletop PL, the electrical drive EA has such low frictional forces and the like that a downward movement of the tabletop PL is not prevented and it therefore slips downward. For example, such a low self-locking of the drive EA can be achieved by using a high spindle pitch for the spindle SP. If a gear unit is used, a gear unit with a low transmission ratio can also be used in order to keep self-locking low. The braking mechanism BR is accordingly provided to selectively prevent a downward movement of the table under a corresponding load, so that even in operation under a load, a stable position of the table or the tabletop PL is guaranteed, despite the low self-locking of the electrical drive.

The defined load is preferably chosen well below a load that would lead to a destruction of the mechanical components of the table TBL. For example, the defined load is based on a weight of the tabletop PL with or without any standard devices placed on top of the tabletop PL like a telephone set, a display, a keyboard etc.

The forces acting on the table TBL are shown for the sake of example in FIG. 1. A force $F_L$ due to the tabletop PL and an associated load acts in a downward direction in this case. It is counteracted by the frictional forces $F_R$ of the electric drive EA in the two table legs TB1, TB2, a spring force $F_S$ from mechanical springs FE in the table legs TB1, TB2, and if the braking mechanism BR is activated, a braking force $F_B$. The frictional force $F_R$ is composed, for example, of the sum of all frictional moments, the static friction of a guide for the drive, a braking torque of the motor and other losses in the drive. In order to keep the position of the tabletop PL stable, it is necessary that the sum of the forces $F_R+F_S+F_B$ is equal to the force $F_L$ acting from above.

The braking mechanism BR is deactivated during a height adjustment of the tabletop PL, so that the force $F_B$ in the formula above drops out and only the forces $F_R$ and $F_S$ counteract the force $F_L$. In an upward movement, however, the drive force of the motor EM, which brings about the upward movement, is added. In a downward movement on the other hand, no additional exertion of force by the motor EM is typically necessary; instead, the potential energy of the tabletop PL during the downward movement can even be used and stored in this case. In particular, a part of the potential energy of the table top PL is stored as spring energy by the compression of the spring FE, for example. This spring energy can be converted back into potential energy during the upward movement. Thereby the electrical drive EA or the electric motor EM is subjected to a lower load or can be designed for a lower power.

In addition, the electric motor EM is driven by the weight of the tabletop PL during a downward movement of the tabletop PL and can accordingly be operating in so-called generator mode. Thereby it is possible for the potential energy of the tabletop PL to be converted at least in part into electrical energy, which can be temporarily stored in an electrical energy accumulator, constructed in the present embodiment as a rechargeable battery BAT. This temporarily stored energy can also be converted back into potential energy during an upward movement of the tabletop PL.

Due to the temporarily stored electrical energy, it is possible to operate the electrical drive EA, in contrast to conventional height-adjustable tables, without a power adapter that generates the electrical energy required by the controller STRG or the electrical drive EA from a line voltage. Instead, it is possible or sufficient in the illustrated embodiment of the table TBL to charge the battery BAT only from time to time with a small charging current. The resulting longer charging times are negligible due to the typically minor adjustment activities on a height-adjustable table.

In different configurations, a capacitor can be used as an electrical energy accumulator, alternatively or additionally to the rechargeable battery BAT. In addition to the mechanical spring FE, storage of mechanical energy can also be accomplished by a flywheel or a mass element for stored potential energy, which is realized by a cable drive for example.

In different configurations, the controller STRG comprises an H-bridge for controlling the drive EA, for example. The H-bridge is designed as an H-shaped bridge with transistor switches, which allow a voltage connection to the electric motor EM. In particular, both a motor-mode operation and a generator-mode operation or braking operation can be per-formed with the H-bridge. This makes it possible in generator mode or braking mode for the energy resulting from the movement of the motor EM to be temporarily stored in the energy accumulator or battery BAT.

It is also possible with the H-bridge to keep the system in a rest position with the braking mechanism BR deactivated, in order to allow a soft startup of the drive from the controlled rest position. A soft stop from the travel movement of the drive EA to a rest state is also possible. The H-bridge preferably works together with the braking mechanism BR so that both the activation and deactivation of the braking mechanism as well as the control of the drive EA can be coordinated by the controller STRG.

In order to charge the electrical energy accumulator or the battery BAT, a charging mechanism that charges the battery BAT can be provided in the controller STRG or on the table TBL. For example, such a charging mechanism comprises one or more solar cells, whose absorbed energy is used to charge the battery. Alternatively or additionally, it is also possible for the charging mechanism, in particular the controller STRG, to be connected to a computer interface via which the charging current for the battery can be supplied. Such a computer interface can be a Universal Serial Bus, USB, interface or an Ethernet interface operated according to the Power over Ethernet standard. Because height-adjustable desks are often used as computer workplaces, it is possible to use an already existing computer or its interface for charging the electrical accumulator. Thus, it is possible to forgo a separate power adapter or even a charging component for the rechargeable battery BAT.

It is also possible to use the computer interface of the controller for a data transmission, particularly for control data for controlling the drive. Thus, the controller can exchange data via the computer interface with a computer connected via the interface. This makes it possible, for example, to control the table TBL with appropriate software that is executed on the connected computer.

Figure 2:
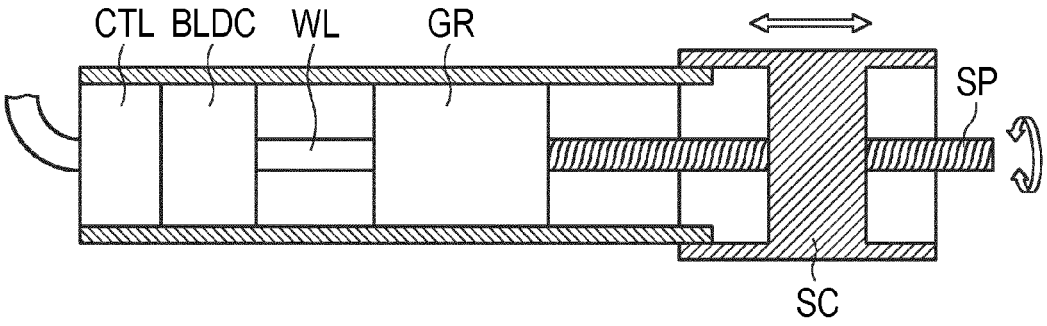
FIG. 2 shows an embodiment of an electrical drive.
Figure 3:
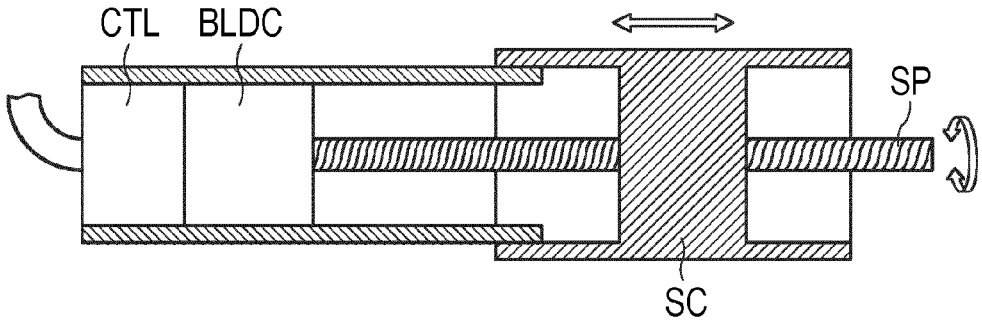
FIG. 3 shows another embodiment of an electrical drive.

In the embodiment shown in FIG. 1, a linear actuator is used for the electrical drive EA. FIG. 2 and FIG. 3 each show special configurations of a linear actuator with a brushless DC motor BLDC.

The linear actuator or linear drive is shown in FIG. 2 in cross-section and comprises a control unit CTL arranged directly on the motor BLDC and forming a unit therewith. Connection lines for supplying the control unit CTL with power and/or control signals are arranged on the control unit CTL. In particular, these connection lines are connected to the controller STRG. The motor BLDC is connected mechanically via a shaft WL to a gear unit GR that drives a spindle SP. The gear unit GR is designed, for example, as a planetary gear unit. A carriage SC, which can move to the right or left under a corresponding rotation of the spindle SP, i.e. along the rotational axis of spindle SP, is placed on the spindle SP via a spindle nut, not shown here.

The control unit CTL can alternatively also be arranged separately from the motor BLDC, for example inside the linear drive or inside the controller STRG.

The brushless DC motor BLDC has a low overall height. Nevertheless, a large stroke of the linear drive can be achieved with the illustrated arrangement. Thus, a good ratio between stroke and overall height of the drive can be achieved with the illustrated arrangement.

FIG. 3 shows another embodiment of a linear drive with a brushless DC motor BLDC. In contrast to the embodiment of FIG. 2, the motor BLDC in this case is provided for direct driving of the spindle SP, without the need for a gear unit. Thereby the linear drive can be constructed even smaller or with a lower overall height.

The braking mechanism can be formed by one brake element or a combination of several brake elements. For example, the braking mechanism accordingly comprises a catch device on the spindle SP of the drive EA in which, for example, a gear engages with the threaded spindle in order to prevent rotation of the spindle SP. This corresponds, for example, to the braking mechanism BR in the embodiment illustrated in FIG. 1. Alternatively or additionally, other mechanical or electromechanical retaining means can also be provided, e.g. a mechanical brake or an electronically operable locking concept. In this case, an electromagnetically movable pin is engaged or disengaged with a gear, a toothed rack or a similar locking device.

Figure 4:
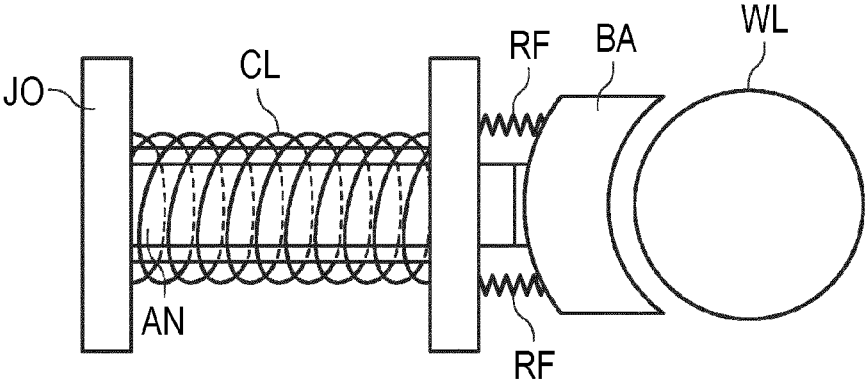
FIG. 4 shows an embodiment of an electromechanical braking mechanism.

In another configuration, a brake element as a component of the braking mechanism is formed by a friction brake on a motor shaft of the drive EA. FIG. 4 shows an embodiment example of such a friction brake. The friction brake here comprises a stationary yoke JO and a movable armature AN, which is connected to a brake shoe BA. The brake shoe BA can be brought into direct contact with the shaft WL of the motor EM, in order to use the resulting friction to prevent rotation of the shaft WL. For this purpose, the friction brake comprises a coil CL that is wound around the yoke JO or the armature AN and induces a movement of the armature AN when current flows. Retraction springs RF, which can bring the armature or the brake shoe into a rest position when the coil CL has no current flow, are also provided between the yoke JO and the brake shoe BA. Such a rest position can correspond either to an activated brake or a deactivated brake.

In principle, the individual brake elements or the braking mechanism can be designed in various embodiments for operation according to the frictional engagement principle or the positive engagement principle. Accordingly, a brake element can be formed as a self-regulating friction brake, for example.

Figure 5:
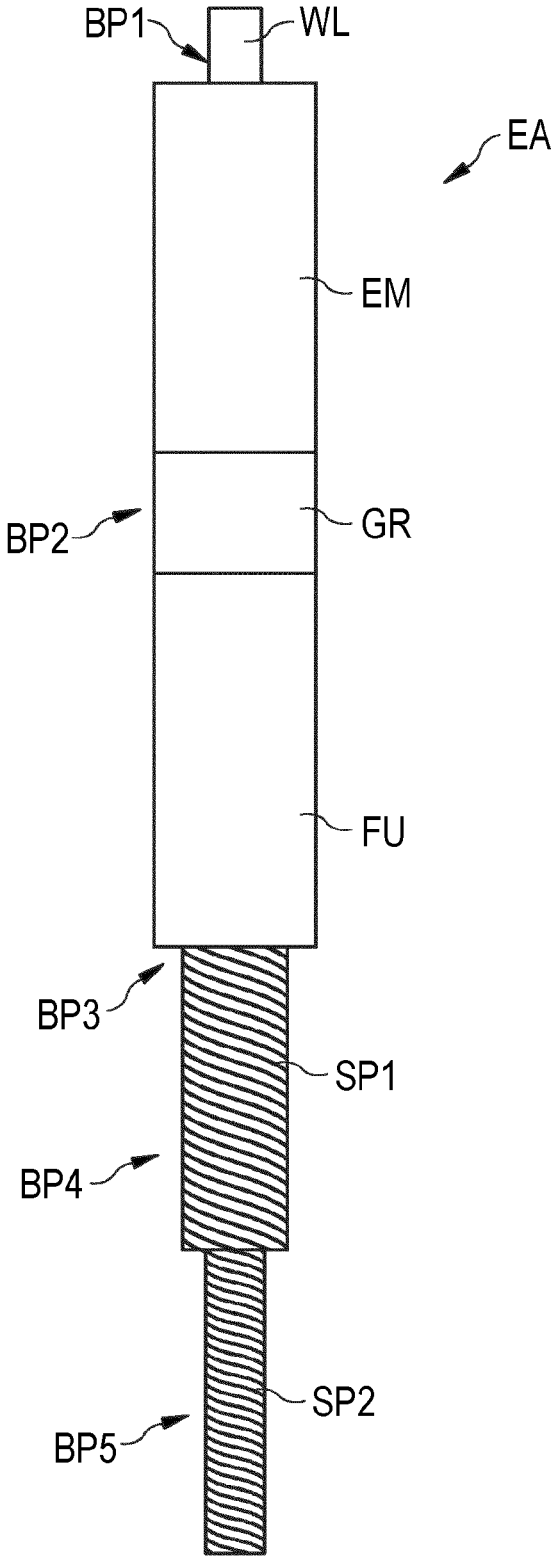
FIG. 5 shows another embodiment of an electrical drive.

FIG. 5 shows, for the sake of example, a detailed view of an embodiment of an electrical drive EA on which several possible points of attack for brake elements or for locking the drive EA are indicated. For example, a braking mechanism can act on the motor shaft WL at a point of attack BP1, corresponding to the embodiment shown in FIG. 4. It is also possible for a braking mechanism to act on the gear unit GR at a point of attack BP2, by means of a locking device for example, particularly a gear that can engage with the gear unit of the drive EA. At another possible point of attack BP3, the braking mechanism can act on a connection between a guide FU and a first spindle SP1. At points of attack BP4, BP5 on the first spindle SP1 or a second spindle SP2, it is possible to provide catch devices which, similarly to that which was described above for the point of attack BP2 for the gear unit GR, engage by means of a gear with the threaded spindle, or in which an electrically movable pin engages and disengages with a gear, a toothed rack or a similar catch device.

Figure 6:
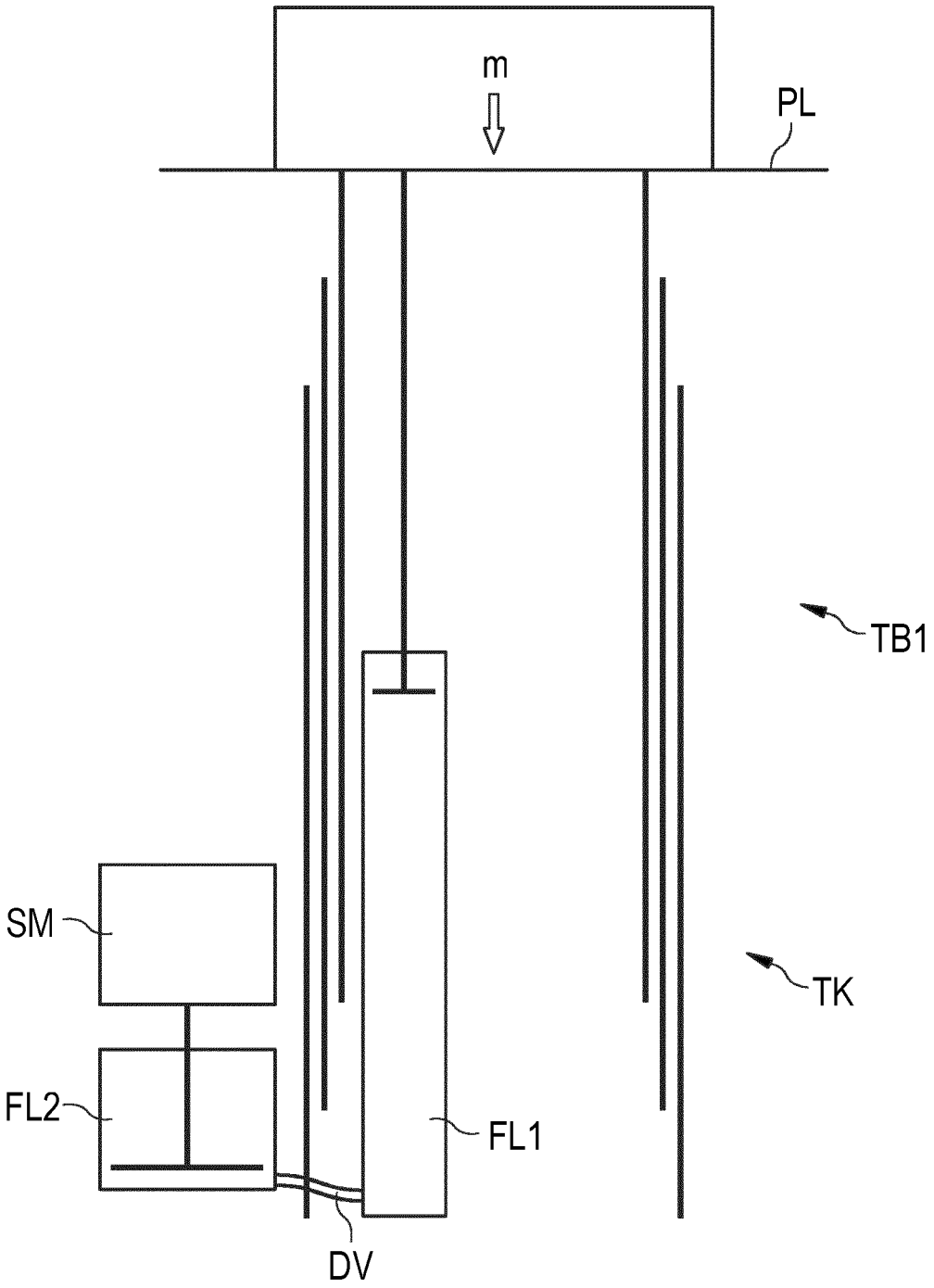
FIG. 6 shows an embodiment of a mechanical energy accumulator.

FIG. 6 shows an embodiment of a mechanical energy accumulator that can be used in a table TBL according to one of the previously illustrated embodiments. In particular, a table leg TB1 underneath a tabletop PL, which is loaded by a mass m, is shown here only for the sake of example. The table leg TB1 has a telescopic extension TK that is constructed in three parts. A first fluid cylinder FL1, in which a fluid is pressed during a lowering of the tabletop PL hydraulically via a pressure connection DV into a second fluid cylinder FL2, is arranged in the interior of the telescopic extension TK. Thereby a storage mass SM on the second fluid cylinder FL2 is pressed upward, so that the potential energy of the storage mass SM increases. Due to the different diameters of the fluid cylinders FL1, FL2, a larger stroke of the tabletop PL is converted into a smaller stroke of the storage mass SM. Thus, the energy that is released during lowering of the tabletop PL can be temporarily stored as potential energy in the storage mass SM. In an upward movement of the tabletop PL, this potential energy of the storage mass SM can be again released in order to convert it into the potential energy of the tabletop PL. The size relationships of the illustrated elements are not to be understood as true to scale, and are used essentially for the sake of better representation of the described principle for energy storage.

Figure 7:
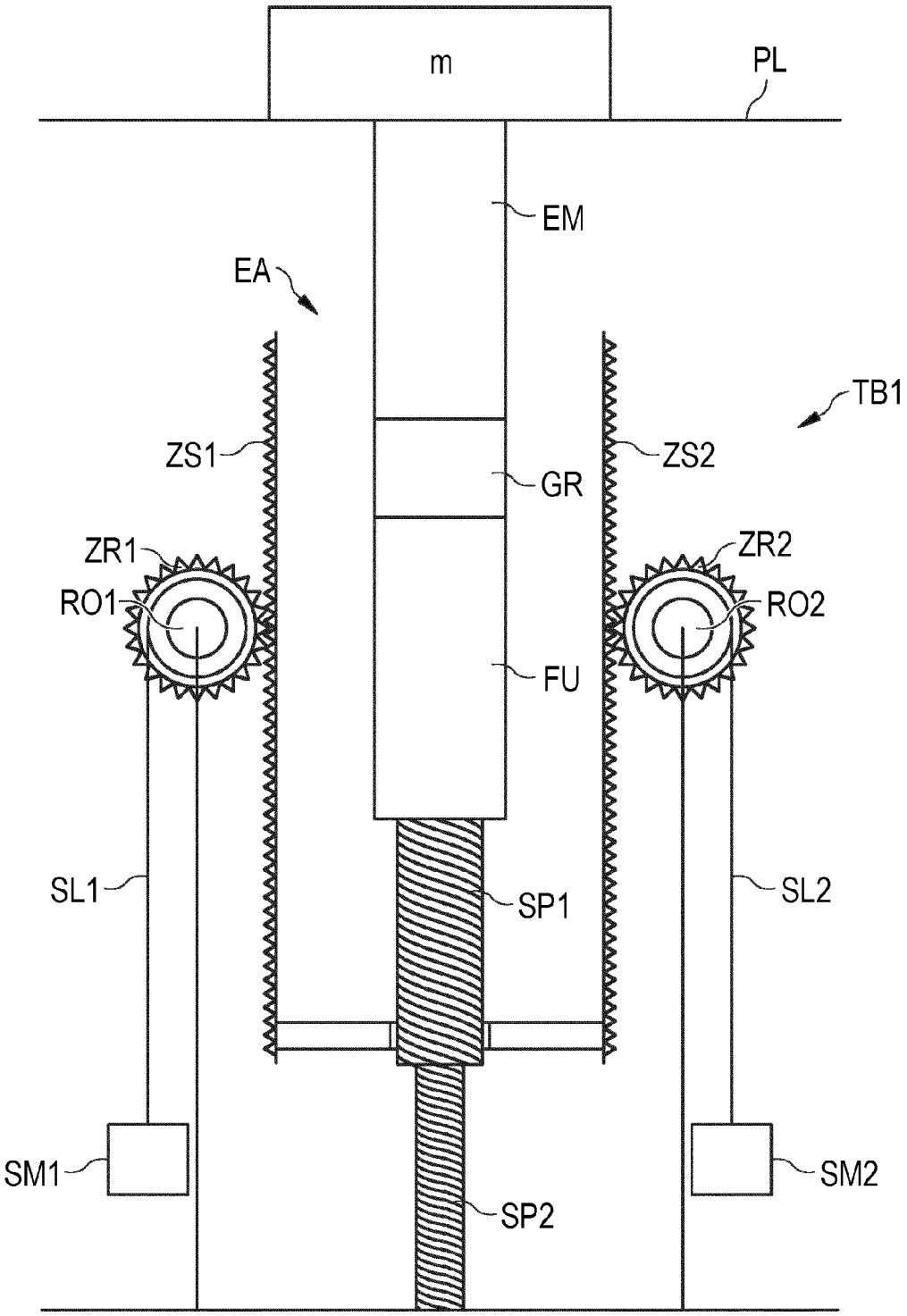
FIG. 7 shows another embodiment of a mechanical energy accumulator.

FIG. 7 shows an additional embodiment example of the mechanical energy accumulator. Again, a table leg TB1 of a table is shown, the table leg comprising an electrical drive EA which is constructed similarly to that shown in FIG. 5. A central guide tube having a first and a second toothed rack ZS1, ZS2 is arranged on the spindle SP1. These toothed racks ZS1, ZS2 engage in corresponding gears ZR1, ZR2, each driven by respective rollers RO1, RO2. Cables SL1, SL2, at the ends of which storage masses SM1, SM2 are mounted, are wound onto the rollers RO1, RO2.

In a downward motion of the tabletop PL, the central guide tube with the toothed racks ZS1, ZS2 moves downward, so that a rotational movement of the gears ZR1, ZR2 is effected, which causes the cables SL1, SL2 to be rolled up. Thereby the storage masses SM1, SM2 are moved upward, so that their potential energy increases. Accordingly, potential energy is temporarily stored in the storage masses SM1, SM2 during a downward movement of the tabletop PL. In an upward movement of the tabletop PL, this potential energy temporarily stored in the storage masses SM1, SM2 can be again released in order to supply it to the potential energy of the tabletop PL.

The illustrated embodiments of the mechanical energy accumulator shown for the sake of example can be combined both with one another and with the previously described electrical energy accumulators.

In the linear drives illustrated in FIGS. 2 and 3, the mechanism composed of spindle SP and carriage SC preferably comprises a ball screw, which has a high efficiency of driving.

In the previously described embodiments, the electrical drive has no self-locking, so that potential energy can be temporarily stored in an energy accumulator during downward motion of the table in order to be able to reuse the stored energy in an upward movement. Thereby the efficiency, in particular the energy efficiency, of such a system is improved in comparison to conventional height-adjustable tables. The lack of self-locking is compensated by the provision of a separate braking mechanism. Due to the buffered energy and the high efficiency that results from the low self-locking, only a small amount of energy need be supplied externally. In particular, such a height-adjustable table can also be operated with rechargeable batteries that are charged with a low charging current via solar cells or a very weak power adapter in a distributed manner. Thus, it is possible to forgo provision of a power adapter. In particular, a height-adjustable table according to the described embodiments can be operated without the presence of a line voltage.

The invention claimed is:

1. A table (TBL) with a height-adjustable tabletop (PL), the table (TBL) comprising:

a braking mechanism (BR) for prevention of a downward movement of the tabletop (PL), an electrical drive (EA) for height adjustment of the tabletop (PL), wherein a self-locking of the drive (EA) is designed in such a manner that, for a defined load on the tabletop (PL), a downward movement of the tabletop (PL) takes place when the braking mechanism (BR) is deactivated, an H-bridge for controlling the drive (EA), and an energy accumulator (BAT), which comprises an electrical accumulator that is coupled to the H-bridge for outputting and absorbing energy, wherein energy resulting from a downward movement of the tabletop (PL) is stored at least in part in the energy accumulator (BAT).

2. The table according to claim 1, in which energy stored in the energy accumulator (BAT) is used for an upward movement of the tabletop (PL).

3. The table according to claim 1, in which the electrical accumulator comprises one of the following:

a rechargeable battery (BAT); and a capacitor.

4. The table according to claim 1, in which the H-bridge is designed to cooperate with the braking mechanism (BR) to control movement of the tabletop (PL).

5. The table according to claim 1, further comprising:

a controller (STRG) for the drive (EA), wherein an energy for the controller (STRG) and/or the drive (EA) is supplied from a rechargeable battery (BAT) comprised by the electrical accumulator.

6. The table according to claim 5, further comprising:

a charging mechanism comprising at least one solar cell for charging the battery (BAT).

7. The table according to claim 5, further comprising:

a charging mechanism for the battery (BAT) and a computer interface, in particular a Universal Serial Bus interface or an Ethernet interface, coupled to the charging mechanism in order to supply a charging current to the battery (BAT).

8. The table according to claim 7, in which the controller (STRG) is designed to exchange data, in particular control data for controlling the drive (EA), with a computer connected via the computer interface.

9. The table according to claim 5, in which the controller (STRG) is designed for an operation without a power adapter.

10. The table according to claim 5, in which the controller (STRG) is designed to perform collision recognition, based on a current in the drive (EA) and/or an energy exchange with the electrical accumulator (BAT), during a movement of the tabletop (PL).

11. The table according to claim 5, in which the controller (STRG) is designed to prevent a downward movement of the tabletop (PL) by triggering the drive (EA) when the braking mechanism (BR) is deactivated, and to control a movement of the tabletop (PL) based on a measurement of a force exertion on the tabletop (PL), particularly on the basis of a current in the drive (EA) originating from the force exertion, or on the basis of a signal from a pressure sensor.

12. The table according to claim 1, in which the braking mechanism (BR) comprises a friction brake on a motor shaft of the drive (EA).

13. The table according to claim 12, in which the friction brake comprises:

an armature;

a coil wound around the armature , the coil designed to induce movement of the armature when current flows through the coil; and a brake shoe connected to the armature, the armature designed to bring the brake shoe into contact with the motor shaft to prevent rotation of the motor shaft.

14. The table according to claim 1, in which the controller (STRG) is designed to deactivate the braking mechanism (BR) during a height adjustment of the tabletop (PL) and to activate the braking mechanism (BR) otherwise.

15. The table according to claim 1, in which the drive (EA) comprises at least one linear actuator, in particular with a spindle drive.

16. A table with a height-adjustable tabletop, the table comprising:

a braking mechanism for prevention of a downward movement of the tabletop, an electrical drive for height adjustment of the tabletop, wherein a self-locking of the drive is designed in such a manner that, for a defined load on the tabletop, a downward movement of the tabletop takes place when the braking mechanism is deactivated, and a mechanical energy accumulator that comprises a mass element for storing potential energy, wherein energy resulting from a downward movement of the tabletop is stored at least in part in the mechanical energy accumulator.

17. The table according to claim 16, wherein energy stored in the mechanical energy accumulator is used for an upward movement of the tabletop.

18. The table according to claim 16, wherein energy resulting from a downward movement of the tabletop is transferred to the mass element via a hydraulical coupling.

19. The table according to claim 16, wherein energy resulting from a downward movement of the tabletop is transferred to the mechanical energy accumulator by a pulley arrangement.

* * * * *